United States Patent [19]

Murashima

[11] 4,343,103

[45] Aug. 10, 1982

[54] FABRIC STRETCHER

[76] Inventor: Kumiko Murashima, P.O. Box 515, Williamstown, N.J. 08094

[21] Appl. No.: 132,826

[22] Filed: Mar. 24, 1980

[51] Int. Cl.[3] ..... D06C 3/00; D06C 3/08

[52] U.S. Cl. ..... 38/102; 38/102.5; 38/102.91

[58] Field of Search ..... 38/102–102.91; 160/382; 211/45

[56] References Cited

U.S. PATENT DOCUMENTS

| | | | |
|---|---|---|---|
| 632,159 | 8/1899 | Steward | 38/102 |
| 636,812 | 11/1899 | Klemenz | 38/102.5 |
| 912,492 | 2/1909 | Roumillat et al. | 38/102 |
| 1,949,061 | 2/1934 | Male | 38/102.91 |
| 1,995,396 | 3/1935 | Moore | 38/102.91 X |

*Primary Examiner*—Louis Rimrodt

*Attorney, Agent, or Firm*—Duffield & Lehrer

[57] ABSTRACT

A fabric stretcher includes a pair of clamps for holding the ends of a length of fabric. Each clamp includes a cylindrically-shaped member which has the fabric wrapped once there around. A semicylindrically-shaped cover member covers the fabric on one side of the cylinder and the fabric is wrapped once again around the clamp so as to force the cover onto the fabric beneath it to hold the same in place. A plurality of rods having pins extending from the ends thereof are located between the clamp members and stretch the fabric transversely.

4 Claims, 4 Drawing Figures

FABRIC STRETCHER

BACKGROUND OF THE INVENTION

The present invention is directed toward a fabric stretcher and more particularly toward such a stretcher which is intended to support a length of fabric which has been dyed so that the same may dry.

Prior devices for stretching fabric or the like while drying have been proposed and are shown, for example, in U.S. Pat. Nos. 632,159 and 912,492. While these prior devices may have some utility when used with relatively narrow and short pieces of fabric, they are not particularly useful with wider and/or longer fabrics. This is particularly true when drying fabrics which have been dyed since these fabrics must be maintained in a horizontal position to prevent the colors from running.

When a length of fabric being dried is suspended in a horizontal position, it tends to bow. That is, the center of the fabric tends to a lower position than the edges thereof. None of the prior art devices known to Applicant can overcome this problem. There is, therefore, believed to be a need for a device which can mantain a piece of fabric in a substantially horizontal position without the same bowing and while the same is being dried.

SUMMARY OF THE INVENTION

The fabric stretcher of the present invention overcomes the problems of the prior art discussed above. This is accomplished by a fabric stretcher which includes a pair of clamps for holding the ends of a length of fabric. Each clamp includes a clindrically-shaped member which has the fabric wrapped once there around. A semicylindrically-shaped cover member covers the fabric on one side of the cylinder and the fabric is wrapped once again around the clamp so as to force the cover onto the fabric beneath it to hold the same in place. A plurality of rods having pins extending from the ends thereof are located between the clamp members and stretch the fabric transversely.

BRIEF DESCRIPTION OF THE DRAWINGS

For the purpose of illustrating the invention, there is shown in the accompanying drawing one form which is presently preferred; it being understood that the invention is not intended to be limited to the precise arrangements and instrumentalities shown.

DETAILED DESCRIPTION OF THE PREFERRED EMBODIMENT

Figure 1:
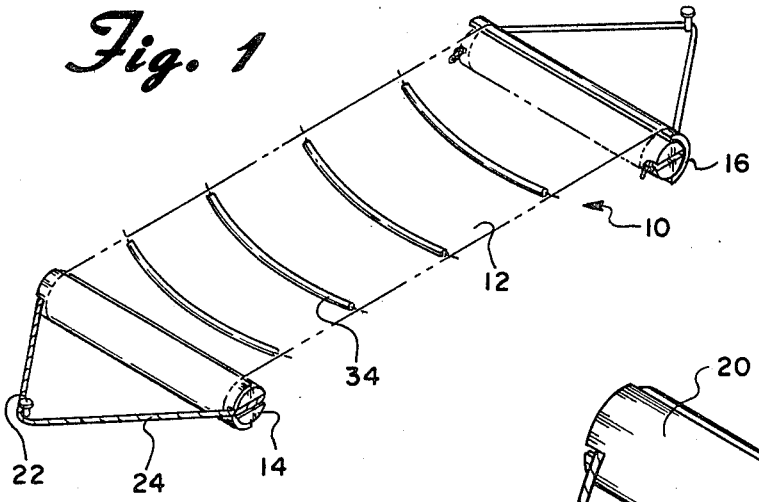
FIG. 1 is a perspective view of a fabric stretcher constructed in accordance with the principles of the present invention.

Referring now to the drawing in detail wherein like reference numerals have been used throughout the various figures to designate like elements, there is shown in FIG. 1 a fabric stretcher constructed in accordance with the principles of the present invention and designated generally at 10. Fabric stretcher 10 is illustrated stretching a piece of fabric 12 which is shown in phantom so that the details of the stretcher per se can be observed.

Fabric stretcher 10 is comprised essentially of a pair of end clamps 14 and 16 which are adapted to hold either end of the fabric 12. End clamps 14 and 16 are identical to each other. Accordingly, only one of the end clamps 14 will be described, it being understood that the following description applies equally to the other end clamp 16.

Figure 2:
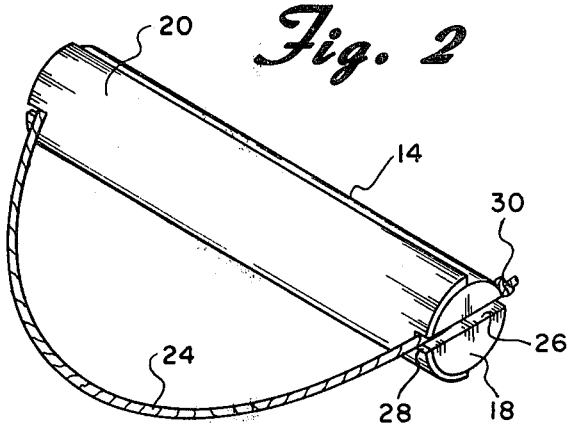
FIG. 2 is a perspective view of one of the end clamps shown in FIG. 1.
Figure 3:
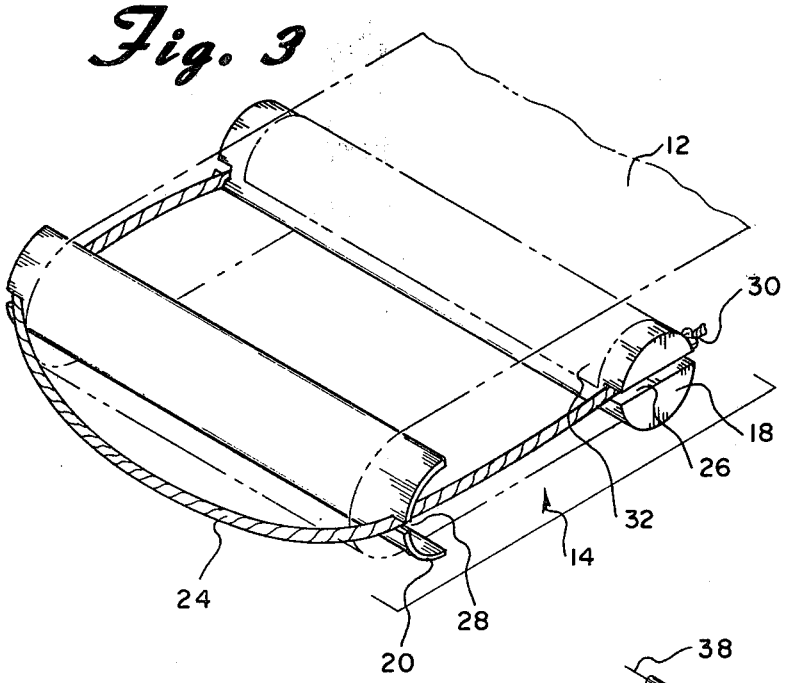
FIG. 3 is a perspective view of the end clamp of FIG. 2 showing the manner in which it secures the end of the fabric.

As shown most clearly in FIGS. 2 and 3, end clamp 14 is comprised of a substantially cylindrically-shaped member 18 having a length which is slightly greater than the width of the fabric intended to be stretched. Cooperating with the cylindrically-shaped clamp member 18 is a semicylindrically-shaped cover member 20. The length of the cover member 20 is substantially equal to the length of the length of member 18. The inner diameter of the cover member 20 is also substantially equal to the outer diameter of the member 18 so that the cover member can closely fit around approximately one-half of the outer circumference of the member 18 as shown most clearly in FIG. 2.

In order to allow the end clamp 14 to be suspended from a fixed point such as a nail 22 (FIG. 1) secured to a wall or table or the like, each end of both the clamp member 18 and the cover member 20 is provided with an aperture through which may pass a rope 24. In the embodiment shown, the aperture 26 in the clamp member 18 and the aperture 28 in the cover member 20 not only pass through the respective members but are also open on the ends thereof. This feature allows the rope 24 to be easily inserted therein. The rope will not fall out during use since, as shown in FIG. 1, the rope 24 is always being pulled inwardly. Alternatively, the apertures 26 and 28 may simply pass through the respective members and need not be open on the ends as shown. A knot 30 formed at the end of the rope 24 prevents the same from being drawn back through the aperture 26.

The fabric 12 is securely held by the end clamp 14 in the following manner. As shown most clearly in FIG. 3, the extreme end 32 of the fabric 12 is first wrapped around the cylindrical member 18 for approximately one full turn. The cover member 20 is then placed over the end 32 of fabric 12 and the fabric is then wrapped once around the cover member. With the cover member in place, it should now be readily apparent that the fabric 12 itself provides the force for clamping the cover member 20 against the cylindrical member 18. The more force which is applied to stretch the fabric 12, the tighter the cover member 20 is held against the cylindrical member 18.

As shown in FIG. 1, the present invention also includes means for stretching the cloth 12 transversely so as to prevent the same from bowing in the middle thereof. These transverse stretcher means are a plurality of elongated rod-shaped members 34 spaced intermediate the end clamps 14 and 16.

Figure 4:
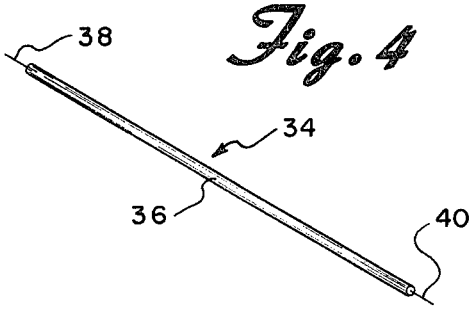
FIG. 4 is a perspective view of one of the plurality of intermediate stretcher rods utilized with the present invention.

As shown most clearly in FIG. 4, each intermediate transverse stretcher member 34 is comprised of an elongated substantially rigid rod 36 having pins 38 and 40 extending axially from either end thereof. While the rod 36 is preferably made of a substantially rigid material, it must be capable of being flexed and have a memory so as to then return to its original shape. Each rod 36 is also preferably of a length which is substantially equal to the width of the fabric 12. In use, pin 38 or 40 of the intermediate or transverse stretcher 34 is inserted through the fabric adjacent one edge thereof. The rod 36 is then flexed so that the remaining pin may then be inserted through the cloth adjacent the other edge thereof. Rod 36 will then tend to straighten out to its original shape and in so doing will stretch the fabric 12 transversely.

While the majority of the component parts of the fabric stretcher of the present invention may be made from numerous different materials, it is preferred that they be made of plastic. Since the fabric stretcher is intended to be used for stretching fabrics which have been dyed, some of the color from the dyes might get on the stretcher parts. If they are made of a plastic material, they can be easily cleaned.

The present invention may be embodied in other specific forms without departing from the spirit or essential attributes thereof and accordingly, reference should be made to the appended claims rather than to the foregoing specification as indicating the scope of the invention.

I claim:

1. A fabric stretcher comprising:

a pair of end clamp means adapted to hold the two ends of a length of fabric, each of said clamp means including a cylindrically-shaped member and an elongated semicylindrically-shaped cover therefor;

means for securing a rope means to each end of each of said clamp means for suspending the same from a fixed support, and a plurality of elongated substantially rigid rod-shaped members having a length substantially equal to the length of each of said clamp means, each of said rod-shaped members including a pin extending axially from each end thereof, said rod-shaped members being capable of being flexed and being adapted to transversely stretch fabric being longitudinally stretched by said clamp means.

2. The stretcher as claimed in claim 1 wherein said securing means includes apertures in the ends of each of said clamp means.

3. The stretcher as claimed in claim 1 wherein the length of each semicylindrically-shaped cover is substantially equal to the length of each cylindrically-shaped member.

4. The stretcher as claimed in claim 3 wherein the inner diameter of said semicylindrically-shaped cover is substantially equal to the outer diameter of said cylindrically-shaped member.

* * * * *